United States Patent [19]

Ramet

[11] 4,130,986

[45] Dec. 26, 1978

[54] ELECTRONIC WATCH, ESPECIALLY ELECTRO-OPTIC DISPLAY WATCH

[75] Inventor: Gilbert Ramet, Cheseaux-Noreaz, Switzerland

[73] Assignee: Ebauches S.A., Neuchatel, Switzerland

[21] Appl. No.: 808,918

[22] Filed: Jun. 22, 1977

[30] Foreign Application Priority Data

Jul. 8, 1976 [CH] Switzerland ..... 8760/76

[51] Int. Cl.[2] ..... G04C 3/00

[52] U.S. Cl. ..... 58/23 R; 58/50 R; 58/85.5; 200/159 R; 200/159 A

[58] Field of Search ..... 58/23 R, 23 BA, 50 R, 58/85.5, 152 R; 200/159 R, 159 A, DIG. 25, DIG. 2

[56] References Cited

U.S. PATENT DOCUMENTS

| | | | |
|---|---|---|---|
| 3,860,776 | 1/1975 | Lockard | 200/DIG. 2 X |
| 3,974,351 | 8/1976 | Solov et al. | 200/DIG. 25 X |
| 3,992,870 | 11/1976 | Dekel | 58/23 BA |
| 4,051,665 | 10/1977 | Arn | 58/23 BA X |
| 4,062,181 | 12/1977 | Zurcher | 58/152 R |

*Primary Examiner*—Ulysses Weldon

*Attorney, Agent, or Firm*—Silverman, Cass & Singer, Ltd.

[57] ABSTRACT

An electronic watch with at least two control push-buttons, two contact studs electrically connected to the watch circuit, and a resilient generally arc-shaped contact blade connected to an earth and disposed between the push-buttons and the studs. Exertion of pressure on one of the push-buttons will cause the blade to contact a single stud to connect the same to earth.

3 Claims, 3 Drawing Figures

ELECTRONIC WATCH, ESPECIALLY ELECTRO-OPTIC DISPLAY WATCH

BACKGROUND OF THE INVENTION

The present invention relates to an electronic watch, especially to an electro-optic display watch, comprising at least two control push-buttons, at least two contact studs electrically connected to the circuit of the watch and a resilient contact blade electrically connected to the earth.

Most electronic watches comprise pushers permitting control of their different functions. This is true, more particularly, with respect to electronic watches having an electro-optic display provided either by luminescent diodes, in which case the display must be "called" by the user of the watch, or having a passive display which comprises generally a lighting device for night reading, which lighting device must be controlled by the user of the watch.

Limited space in watch constructions generally is such that great liberty with respect to the general arrangement of the control pushers, especially their location, is not possible.

SUMMARY OF THE INVENTION

The primary object of the present invention is to provide, for such watches, a construction for the control device which offers a greater flexibility so far as the choice of the location of the pushers is concerned. This permits, primarily, a greater choice in the construction; so far as the and configuration of the watch case to be used.

The watch constructed according to the present invention is characterized by the fact that a resilient contact blade electrically connected to the earth of the watch is interposed between the push-buttons and the contach studs thereof, the arrangement being such that a pressure exerted on one or the other of the pushers elastically deforms the blade and causes it to make contact with at least one of the said studs, and engage the same to the earth.

It is known to provide electronic watches with push-buttons carried by a resilient blade electrically connected to the earth of the watch. Such push-button usually are situated each opposite one contact stud so that the operation of one or the other of the said push-buttons causes the same to make contact with the corresponding stud, and thereby engages the stud to the earth.

In these known constructions, the elastic blade serves as an electric conductor and as a resilient return member, but the pushers must be positioned opposite the contact studs with which they cooperate. Consequently, such arrangements known do not allow the watch fabricator or designer any liberty so far as the choice of the position the control pushers is concerned. The present invention is directed at overcoming such problem of known structures.

BRIEF DESCRIPTION OF THE DRAWING

The drawing shows, by way of example, one embodiment constructed in accordance with the object of the invention.

DESCRIPTION OF THE PREFERRED EMBODIMENT

Figure 3:
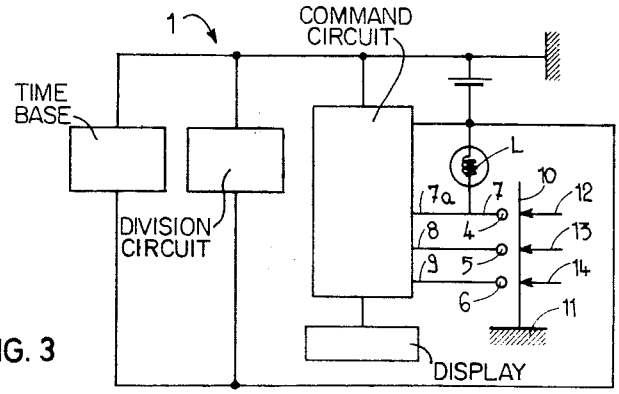
FIG. 3 represents diagrammatically the circuit of said watch with its control device.

The watch as disclosed comprises an electronic circuit diagrammatically represented at 1 in FIG. 3. The circuit 1 is mounted on a substrate 2, positioned in a casing the bezel 3 of which is visible in FIG. 1.

The control device of the several functions of the watch comprises three contact studs 4, 5 and 6 formed of pins which are disposed normal to the plane of the substrate 2. The studs 4, 5, 6 are connected by respective conductive tracks 7, 8 and 9 to the circuit 1. The several functions of the watch are controlled by engaging one or the other of the sutds 4, 5 and 6 to the earth of the watch. Several of the studs may be engaged to the earth at the same time.

For the purpose of effecting engagement of the studs to earth, the control device comprises a resiliently deformable blade 10, having the shape of an arc of circle. The blade 10 is formed at its respective ends **10*a* an ear and an ear 10*b* by means of which the blade 10 is secured to the substrate 2. The blade 10 is arranged edgewise on the substrate, opposite the three studs 4, 5 and 6. The end 10*a* of the blade is connected to the earth at 11**.

Figure 1:
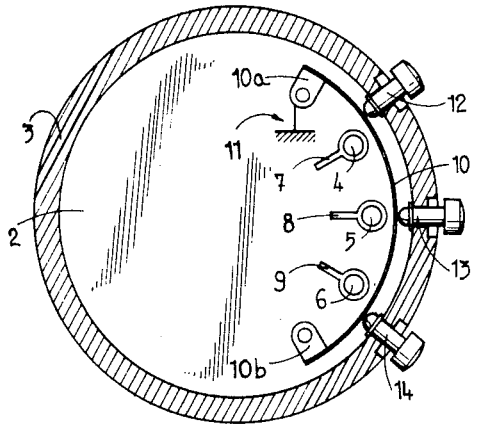
FIG. 1 is a plan view, in partial section, of a part of an electronic wrist-watch, having a passive electro-optic display, with a lighting device for night reading.
Figure 2:
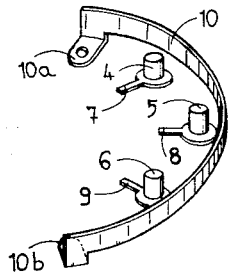
FIG. 2 is a perspective view of a detail of the control device of said watch.

The control device further comprises three pushers 12, 13 and 14 diagrammatically represented in FIG. 1, mounted so as to be radially movable in the bezel 3, in a direction parallel to the plane of the substrate 2. These pushers are arranged opposite the elastic blade 10, which is interposed between the said pushers and the contact studs. One of the pushers, i.e. the pusher 13, is positioned opposite one of the studs, i.e. the stud 5, while the two other pushers are displaced angularly and are positioned opposite the two other studs.

When a force or pressure is exerted on one of the pushers, the pusher then acts on the blade 10 and deforms the blade resiliently in the direction of the center of the watch. Such action causes the blade 10 to contact the nearest stud which is thereupon connected to the earth. The remainder of the blade or a portion thereof is resiliently deformed in a direction away from the center of the watch movement.

Because of the fact that it is not necessary that the pushers 12, 13, 14 be situated opposite the studs they control, the position of the pushers is much more flexible than with the conventional arrangements.

One can, if necessary, provide that the operation of one of the pushers brings the resilient blade simultaneously into contact with two studs.

It is to be noted that the resilient blade 10 serves also as a return spring for the pushers.

FIG. 3 shows that one of the pushers, for instance pusher 12, has a double purpose. This pusher is adapted on the one hand to light the bulb L to illuminates the display device, and on the other hand, by reason of the portion **7*a* of the line 7**, to control a second function. One could, for instance, provide that this second function be controlled only if one of the two other pushers has been operated previously.

What I claim is:

1. An electronic watch of the type having an electro-optic display and several control functions, each function adapted to be activated upon coupling a corresponding control circuit to ground, said watch comprising:

a case including a frame for a movement and at least one wall, a resilient contact blade and means for mechanically securing said blade substantially at each end thereof to said frame and coupled electrically to ground, to provide an unrestrained generally arcuately shaped intermediate portion, at least two control push-buttons mounted on said wall adjacent to and abutted with a first side of said intermediate blade portion, at least two contact studs mounted spaced from a second opposite side of said intermediate blade portion and each connected electrically to respective control circuits, said control push-buttons adapted to be manually moved to elastically deform part of said intermediate blade portion to move said part into contact with at least one of said studs to activate said corresponding control circuit while a second part of said intermediate blade portion is elastically deformed away from said studs.

2. A watch as claimed in claim 1 in which the watch has a movement and the push-buttons are arranged to be moved in directions substantially parallel to the plane of the movement, and wherein said arcuate intermediate portion of said resilient blade is disposed edgewise with respect to the plane of the movement and crosswise to the direction of movement of the push-buttons.

3. A watch as claimed in claim 1 in which at least one of said control push-buttons is at least partially offset along said blade from the stud against which said blade part contacts when said blade portion is deformed by said at least one control push-button.

* * * * *